US005366107A

United States Patent [19]

Rostkowski

[11] Patent Number: 5,366,107

[45] Date of Patent: Nov. 22, 1994

[54] VENTED STORAGE BOX

[76] Inventor: John P. Rostkowski, 680 Old Joppa Rd., Joppa, Md. 21085

[21] Appl. No.: 7,971

[22] Filed: Jan. 22, 1993

[51] Int. Cl.[5] ..... B65D 85/00

[52] U.S. Cl. ..... 220/676; 220/745

[58] Field of Search ..... 220/676, 355, 370, 745, 220/367, 766, 771, 908

[56] References Cited

U.S. PATENT DOCUMENTS

| | | | |
|---|---|---|---|
| 667,497 | 2/1901 | Carroll | 220/745 |
| 1,724,882 | 8/1929 | Meyercord et al. | 220/676 X |
| 1,953,765 | 4/1934 | McCluney | 220/367 X |
| 2,113,683 | 4/1938 | De Witt | 220/367 X |
| 3,074,503 | 1/1963 | Martinich, Jr. | 220/908 X |
| 3,419,184 | 12/1968 | Asenbauer | 220/355 X |
| 4,095,711 | 6/1978 | Conley | 220/766 |
| 4,176,745 | 12/1979 | Stollberg | 220/367 X |
| 4,478,349 | 10/1984 | Haverland, Jr. et al. | 220/771 X |
| 4,819,795 | 4/1989 | Swaney | 220/367 X |

*Primary Examiner*—Steven M. Pollard
*Attorney, Agent, or Firm*—Peter Gibson

[57] ABSTRACT

A rectangular container possessing four substantially vertical walls and a horizontal floor molded in one piece of plastic along with a matching waterproof lid molded in another separate piece of plastic is disclosed. At least two of the four vertical walls possess shielded vents comprising apertures through a wall possessing either screening or louvers or both across the entire aperture and rigidly attached to the wall. The uppermost edge of the four walls possesses a preformed U-shaped resilient edge and the lid possesses a preformed U-shaped resilient perimeter. The full engagement of the lid perimeter with the box uppermost edge results in a removable closure of the box interior which is water resistant proof. In one embodiment, the uppermost edge of the front wall is of a constant height which is less than the constant height of the rear wall and the two side walls possess a height inclined from the front elevation to the rear elevation. The slope of the cover sheds precipitation. Corrugation of the floor, walls and lid is recommended for increased rigidity along with single wall construction. The shielded vents allows gaseous exchange between the box interior and the ambient atmosphere while preventing either the ingress and egress of insects or the entry of rain or both.

16 Claims, 2 Drawing Sheets

FIG 1
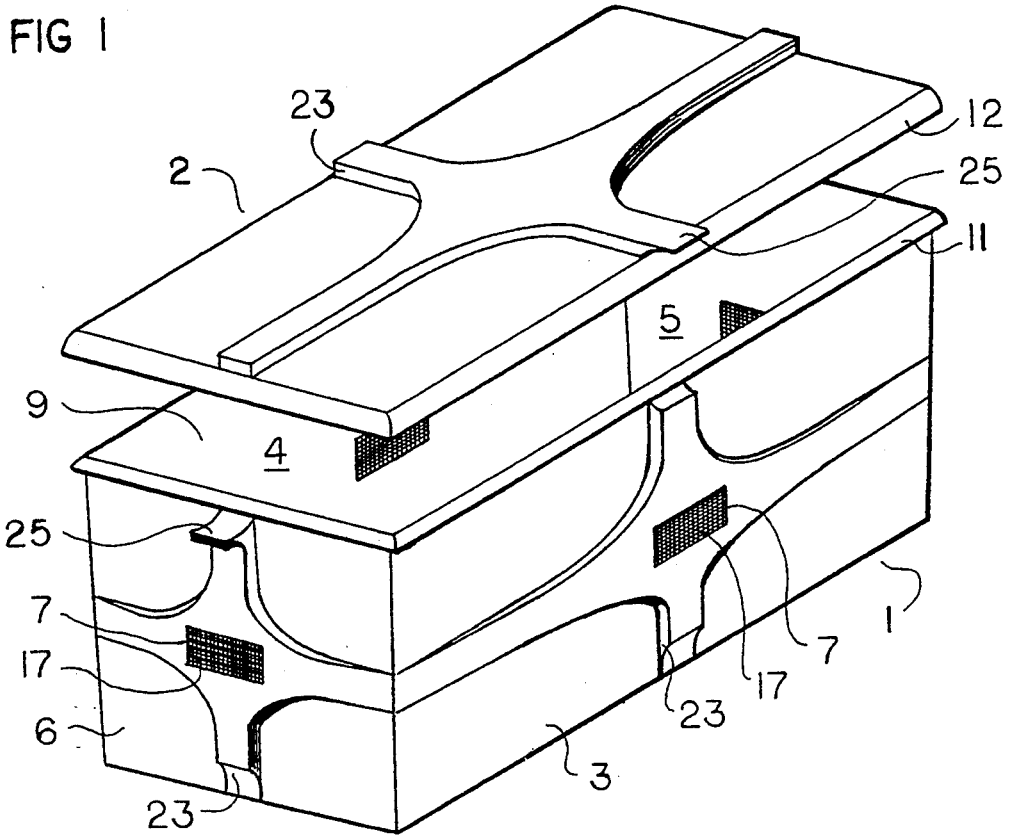
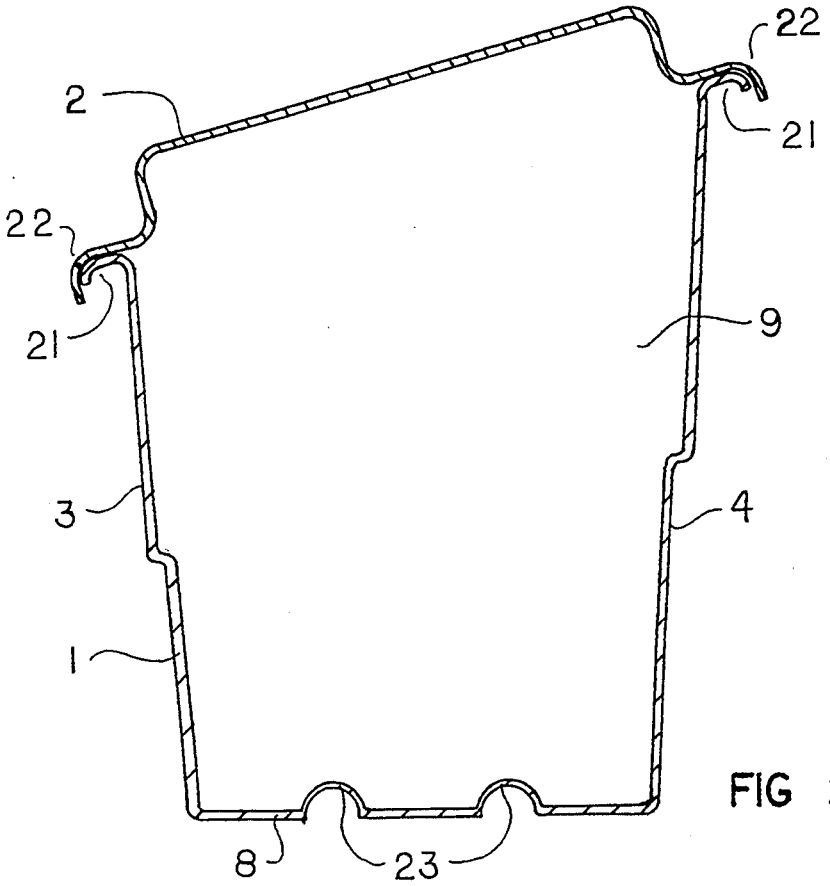
FIG 2

VENTED STORAGE BOX

BACKGROUND OF THE INVENTION

The storage of firewood is typically accomplished by stacking the wood, thus minimizing the upper surface area most vulnerable to precipitation, often using a tarpaulin over the top of the stack to protect the wood from moisture accumulation. Smaller amounts of firewood are often stored against an exterior wall of a house, nearby a door, for the sake of convenience. Such ready supplies often lack any protection from precipitation and, furthermore, pose a threat to the structure of the house in the form of termites and other wood damaging insects which frequently infest firewood supplies.

Storage of firewood in a large, moistureproof container might prevent damage to the wood from precipitation as well as damage to the house from insect infestation, but a fully moisture proof container would promote condensation in the container and fail to let the wood dry more fully. Similarly, there are other materials, such as flammable fluids and woolens, which would be better stored in a container which is largely moisture proof but provided with ventilation. Vapors from flammable fluids such as gasoline used for lawnmowers may pose a danger in a vapor tight container, yet is is preferable to store such fluids in a protected area, ideally with a shielded means of ventilation. The storage of woolens similarly benefits from an environment wherein insects, primarily moths, are excluded, but ventilation is available.

Plastic containers providing moisture proof storage are well known. Containers providing an abundance of ventilation are also well known, primarily in the storage of fruit and vegetables. The requirements of an ideal environment for the storage of small stacks of firewood close to a house, of numerous flammable fluids such as gasoline as well as woolens and other materials, combustible or not, demand a container that is well protected from precipitation and receives ventilation in a manner that is shielded either from the migration of insects or intrusion of flame. There are, however, no known containers which are largely moisture proof possessing means of shielded ventilation.

SUMMARY OF THE INVENTION

The purpose of the present invention is to provide the structure for a container molded in plastic possessing a moisture proof lid or cover and shielded venting means allowing gaseous exchange between the interior of the container with the ambient environment while prohibiting either the migration of insects between the interior of the container and the outside environment or protecting the contents from both precipitation and sources of ignition, or both. A moisture proof lid, molded in one piece of plastic, has a perimeter possessing a preformed U-shaped configuration shaped and sized to fit the upper edge of a rectangular container having a horizontal floor and four substantially vertical walls terminating in said upper edge possessing a preformed configuration such that moisture resistant removable closure of the container by means of resilient deformation is obtained. At least two of the four walls have shielded venting means comprising at least one aperture through one said wall possessing either screening or louvers or both rigidly attached to the wall and fully covering said aperture. The screening comprises a mesh or matrix of members forming a plurality of apertures each possessing a width of less than 0.10 inches. Further embodiments of the principles relating to the present invention also include possession of: 1) enhanced rigidity by means of corrugation, 2) a small inclination to the walls from vertical outward from the floor to enable stacking of a plurality of open containers and 3) a front wall of a height less than the back wall and side walls possessing a height inclined from the front height to the greater rear height.

BRIEF DESCRIPTION OF THE DRAWINGS

FIG. 1 is a perspective drawing which illustrates an embodiment of principles relating to the present invention wherein vents shielded by screening, without louvers, all four walls of equal height and formed handles are depicted.

FIG. 2 is a cross sectional drawing taken from the midsection of FIG. 3 which illustrates the U-shaped preformed configuration of the lid perimeter and the container upper edge as well as floor corrugation.

DETAILED DESCRIPTION OF THE INVENTION

Figure 3:
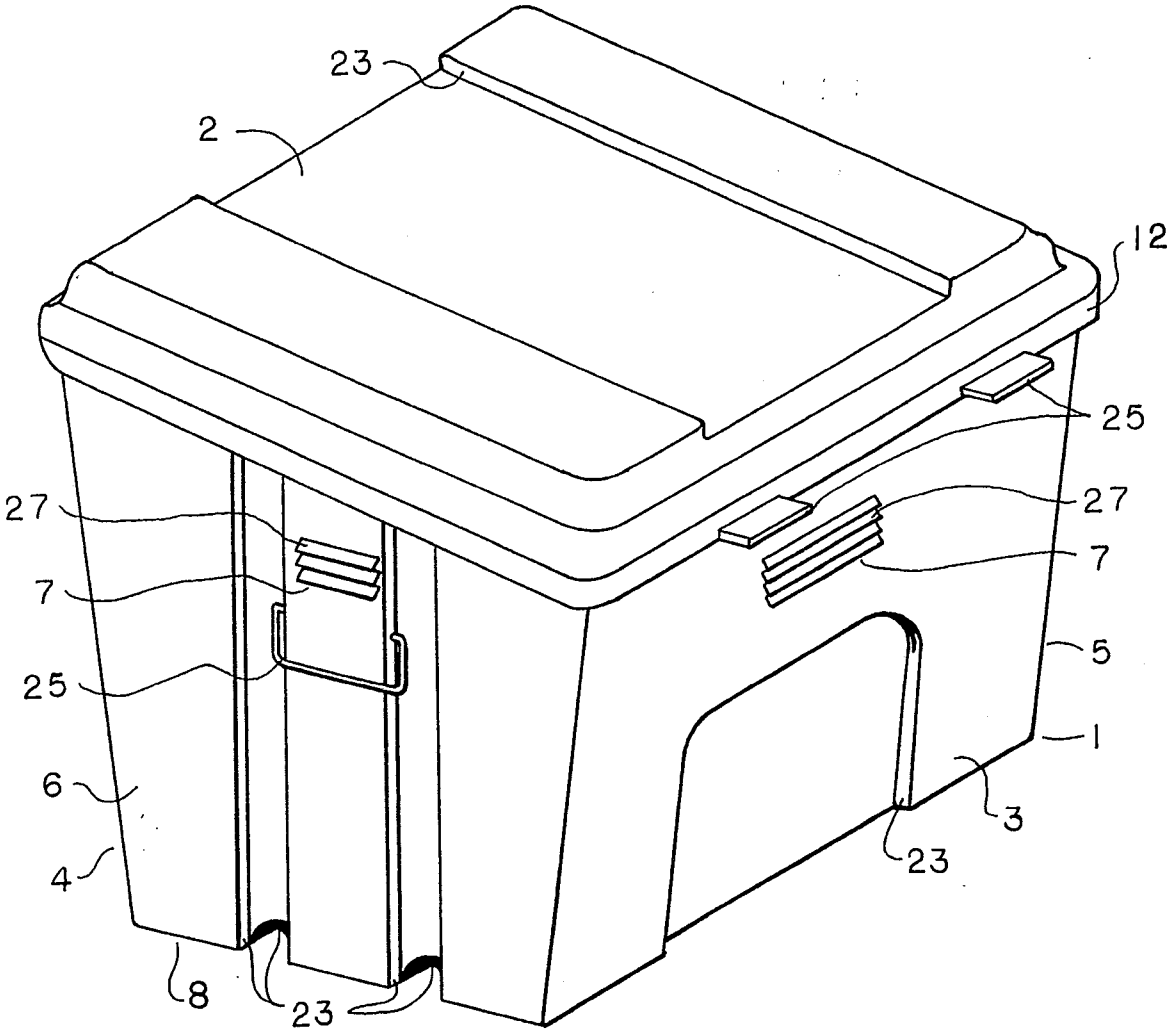
FIG. 3 is a perspective drawing which illustrates another embodiment of principles relating to the present invention wherein vents shielded by louvers, a front wall of lesser height than the rear wall and hinged handles are depicted.

An embodiment of principles relating to the present invention comprises a molded plastic rectangular box 1 and a suitably shaped moisture proof lid 2, as seen in FIG. 1. The box 1 possesses four substantially vertical walls; a front wall 3, back wall 4, right side wall 5 and left side wall 6. At least two of these four walls possess a shielded vent 7 which comprises an aperture through said wall shielded by screening 17 rigidly attached to the wall and fully covering said aperture. This screening is not necessarily of the conventional aluminum or copper mesh variety typically employed in housing, but may also be of plastic, preferably molded of one piece with the entire box 1. The screening 17 must be made of a corrosion resistant material and must comprise a matrix of members which present a plurality of small apertures each possessing a width smaller than one tenth of an inch, (0.10").

Shielded vents are depicted in another embodiment illustrated in FIG. 3 wherein louvers 27 are utilized. Screening 17 may also be employed in the manner described above or may be omitted without deviation from the principles relating to the present invention; the louvers 27 are a form of shielding the vents 7. It is apparent that louvers 27 will not prevent the migration of insects from or into the box interior 9 but provide for ventilation while protecting the box interior 9 from precipitation and sources of ignition. In regard to the principles relating to the present invention, louvers are an auxiliary feature; useful in fulfillment of the stated purpose either as an adjunct to screening or as a means itself of shielding the vents.

The box 1 and suitably shaped lid 2 illustrated in FIG. 3 is depicted in cross section by FIG. 2 which illustrates the U-shaped preformed configuration of the lid perimeter 12 and the mating preformed configuration of the box upper edge 11. The lid 2 is moisture proof and the closure of the box interior 9 effected by full communication of the lid with the box upper edge 11 is similarly moisture resistant. This moisture proof closure is achieved by means of resilient deformation of the preformed configuration of either the box upper edge 11 or the lid perimeter 12 when the two are placed in full communication, i.e. securely shut. This type of closure is well known in the art and provided the basis for numerous patents by Tupper, among others. It is not the intention of the present disclosure to explore any new means of closure by resilient deformation of a preformed configuration but merely to identify this general class of closure as the means by which a lid engages a box in order to provide a moisture proof closure of the same.

The embodiment of principles relating to the present invention illustrated in FIG. 3 depicts an inclination of the lid 2 from horizontal. One major intention of the present invention is to protect the interior 9 of the container and, obviously, the contents therein, from precipitation. Storage of firewood or inflammatory fluids outdoors constitute two separate, specifically intended purposes of the present invention and either purpose is enhanced by a sloping cover for two reasons. One reason is that such an inclination facilitates the shedding of precipitation, either rain, sleet or snow. A second reason is provision of greater and easier access to the contents of the container. Given any rectangular container of certain dimensions, the surface area of the rectangle, here represented by the floor 8, is less than the surface area of a plane intersecting the enclosed volume at an angle to normal compared with the normal planar intersection. In other words, an inclined top possesses a greater surface area than a horizontal top for a container of the same rectangular dimensions owing to the vertical component exposed therewith. By the same reason, opening a vertical component facilitates the placement of articles into and removal of articles from, the interior 9.

As illustrated in FIGS. 1–3, the substantially vertical walls 3, 4, 5 & 6, possess a small inclination outward from vertical in extension from the floor 8 to the upper edge 11 of the container. This small inclination from vertical facilitates vertical stacking, or nesting, of a plurality of containers, lids aside, in order to economize the space, or floor area, necessary to accommodate a given number of containers. This feature possesses obvious value to retail merchants, any manufacturer or distributor of any product made in accordance with the principles relating to the present invention although adherence to said principles does not require employment of this feature which is a commonplace among molded plastic containers and represents in itself nothing new in the art.

Similarly, the embodiments of the principles relating to the present invention illustrated in FIGS. 1–3 exhibit a form of corrugation as a means of obtaining enhanced rigidity of the entire construction including the box 1, the floor 8, the walls 3–and the lid 2. Corrugation, in the sense of this disclosure, is taken as the alternation of raised or lowered portions of the surface of a broad area of the relevant structures. Any such corrugation involves portions of the surface which are inclined with respect to the broad surface of the structure. Corrugation, in this sense, is not restricted to the regular alternation of parallel areas of raised or lowered surfaces with respect to the broad surface of construction but encompasses any form of enhancing the rigidity of a generally broad surface by means of either depression or projection of any portion of the broad surface utilizing portions which are inclined and small with respect to the broad surface. It is not the intention of this disclosure to reveal any new type of construction with regard to this common practice but merely to recognize this practice as useful to the achievement of the principles relating to the present invention.

Another feature represented in FIGS. 1 & 3 also possesses obvious utility in the fulfillment of the principles relating to the present invention but is itself old in the art. Handles 25 on the lid 2 possess obvious utility in facilitating the removal of the lid from the box 1. Handles 25 on the box 1 similarly facilitate manual transport of the entire container. The handle(s) 25 on the lid 2 consist merely of a projection of the lid beyond the plane of the front wall 3 sufficient to enable placement of a couple or more fingertips in order to exert force upon the lid perimeter 12 upwards, away from the box 1. The handles 25 on the box 1 similarly afford a convenient purchase for exertion of force upwards in order to displace the entire container.

FIG. 1 illustrates a handle 25 on the left side wall 6 molded as a protrusion from that wall. It is assumed that the right side wall 5, obscured in this view, is similarly equipped. For purposes of transporting the entire container, one handle each must be placed upon the exterior of two opposed walls. The side walls are the obvious choice for this purpose. FIG. 3 depicts a dependent handle 25 upon the left side wall 6. An identical handle is assumed to be attached to the right side wall 5 which is obscured in this view. The handle shown here possesses a rotatable attachment to the side wall such that the handle is free to rotate about a pivot proximate the surface of the side wall to a position inclined with the wall and hangs substantially flush with the wall when not in use.

The best method of construction of an embodiment of principles relating to the present invention is considered forthwith. It is advised that the box 1 and the lid 2 each be made in plastic by a molding process, each in one separate piece. Furthermore, a single wall construction is regarded as sufficient while corrugation, in the broad sense defined above, of every broad exterior surface is highly recommended in order to enhance the rigidity of the entire construction. If louvers 27 are utilized, it is recommended that these be molded in one piece with the box 1. As a practical aspect, if louvers are utilized and are molded in one piece with the box, screening 17 cannot easily be molded in one piece with the box and must be fixedly attached to the relevant wall. In this case, it is recommended that the screening be attached to the interior surface of the relevant wall such that the entire aperture of which the vent is comprised is shielded by the screening which may be attached to the wall by any suitable means.

It is considered best, regardless of whether louvers are employed or not, that attachment of screening to the relevant wall be effected by molding the box with the screening in place such that the screening is embedded in the perimeter of the aperture of which the vent is comprised. Alternatively, the screening may be affixed to the interior of the relevant wall by means of adhesive, staples or any suitable means. The screening may also be attached to the exterior surface of the relevant wall by any suitable means but this is not recommended. It is also feasible to attach louvers, if utilized, to the exterior of the relevant wall, thus allowing the screening to be molded of plastic in one piece with the box.

It is recommended that the handle(s) 25, if employed, on the lid be molded in one piece with the lid and further, that this consist of a substantially planar protrusion of the lid beyond the plane of the exterior surface of one of the four substantially vertical walls. Alternatively, a pair of similar protrusions may be placed on one edge or opposed edges of the lid. Given the symmetry of the embodiments of the principles of the present invention disclosed, the front of the lid is no different from the rear except for the placement of a handle or pair of handles, even if the box 1 has a front wall 3 which is lower in height than the rear wall 4 which necessitates an incline along the upper edge of both the side walls 5 & 6. Consequently, the location of a handle or pair of handles on the lid is not important and a single, continuous handle about the entire lid periphery is also appropriate.

In regard to the utilization of handles 25 upon the box 1, placement of a pair, one each upon the exterior surface of opposed walls, is an obvious necessity and placement upon the side walls 5 & 6 is an obvious recommendation. Handles 25 molded in plastic of one piece with the box 1 as shown in FIG. 1 are considered to be best in comprising the simplest and least expensive construction. Handles 25 which are pivoted to the box 1 as shown in FIG. 3, however, afford a grip superior to that afforded by the molded type of handle. In this case a metal rod is formed by methods well known to the routinier to approximate a conventional shape for a handle which terminates in two opposed free ends which are each inserted into an aperture, either through or blind, formed in a protrusion of the box wall substantially normal the planar surface of that wall such that the medial portion of the handle is parallel to the plane of the wall and rotates upon the pivot so effected in a direction normal to the wall.

While the foregoing provides a full and exact description of various embodiments of the principles relating to the present invention, it is emphasized that said description is supportive and is in no manner restrictive of the rights and privileges secured by Letters Patent for which I hereby claim:

1. A container comprising a molded plastic box possessing shielded venting means and a moisture proof rectangular molded plastic lid;

said molded plastic box possessing a horizontal, rectangular floor and four substantially vertical walls extending from the periphery of said floor disposed substantially perpendicular to said floor and to each adjacent wall forming a box interior comprising a rectilinear volume bounded by the contiguous interior surfaces of said floor and said four walls which, further, terminate in a continuous edge distal said floor and possessing a preformed configuration;

said moisture proof rectangular molded plastic lid possessing a perimeter comprising a preformed U-shaped configuration of sufficient resilience to grip said preformed configuration of said terminal edge of said four walls such that said lid provides a removable closure of said box interior retained by resilient distortion of said preformed resilient U-shaped configuration when in full communication with said terminal edge of said four walls, said full communication providing a moisture resistant barrier;

at least two of said four walls possessing shielded venting means comprising at least one aperture through one said wall entirely covered by corrosion resistant screening fixedly attached to said wall comprising a matrix of members defining a plurality of apertures each of a dimension smaller than 0.10 inches thus providing said box interior with means of gaseous exchange with the exterior ambient atmosphere while providing an effective barrier against the migration of insects.

2. A container in accordance with claim 1 wherein one of said four substantially vertical walls possesses a height greater than the height possessed by the wall opposite and the two other walls possess a height linearly inclined between the greater and lesser heights of said opposed walls.

3. A container in accordance with claim 1 wherein said floor, each of said four walls and said lid each possess a substantially planar exterior broad surface of which at least one is corrugated.

4. A container in accordance with claim 1 wherein said lid possesses at least one handle comprising a projection of said lid beyond the plane of said front substantially vertical wall when said lid is in full communication with said wall upper edge.

5. A container in accordance with claim 1 wherein said box possesses two handles, each said handle comprising a projection from one of said substantially vertical side walls and is molded in one piece with said box.

6. A container in accordance with claim 1 wherein said box possesses two handles, each said handle comprising a formed member rotatably attached to a pair of projections from one of said substantially vertical side walls molded in one piece with said box.

7. A container in accordance with claim 1 wherein each of said four substantially vertical walls possesses a small inclination from vertical outwards in projection from said floor such that a plurality of said boxes may be stacked one inside each other.

8. A container in accordance with claim 1 wherein sheilded venting means comprising the louvers of claim 2 are also in presence.

9. A container comprising a molded plastic box possessing shielded venting means and a moisture proof rectangular molded plastic lid;

said molded plastic box possessing a horizontal, rectangular floor and four substantially vertical walls extending from the periphery of said floor disposed substantially perpendicular to said floor and to each adjacent wall forming a box interior comprising a rectilinear volume bounded by the contiguous interior surfaces of said floor and said four walls which, further, terminate in a continuous edge distal said floor and possessing a preformed configuration;

said moisture proof rectangular molded plastic lid possessing a perimeter comprising a preformed U-shaped configuration of sufficient resilience to grip said preformed configuration of said terminal edge of said four walls such that said lid provides a removable closure of said box interior retained by resilient distortion of said preformed resilient U-shaped configuration when in full communication with said terminal edge of said four walls, said full communication providing a moisture resistant barrier;

at least two of said four walls possessing shielded venting means comprising at least one aperture through one said wall effectively covered by louvers comprising a plurality of parallel, substantially planar, vertically spaced members each possessing an inclination downward in the direction outward from said wall and fixedly attached to said wall proximate the perimeter of said aperture thus providing said box interior with means of gaseous exchange with the exterior ambient atmosphere while providing an effective barrier against precipitation and sources of ignition.

10. A container in accordance with claim 9 wherein one of said four substantially vertical walls possesses a height greater than the height possessed by the wall opposite and the two other walls possess a height linearly inclined between the greater and lesser heights of said opposed walls.

11. A container in accordance with claim 9 wherein said floor, each of said four walls and said lid each possess a substantially planar exterior broad surface of which at least one is corrugated.

12. A container in accordance with claim 9 wherein said lid possesses at least one handle comprising a projection of said lid beyond the plane of said front substantially vertical wall when said lid is in full communication with said wall upper edge.

13. A container in accordance with claim 9 wherein said box possesses two handles, each said handle comprising a projection from one of said substantially vertical side walls and is molded in one piece with said box.

14. A container in accordance with claim 9 wherein said box possesses two handles, each said handle comprising a formed member rotatably attached to a pair of projections from one of said substantially vertical side walls molded in one piece with said box.

15. A container in accordance with claim 9 wherein each of said four substantially vertical walls possesses a small inclination from vertical outwards in projection from said floor such that a plurality of said boxes may be stacked one inside each other.

16. A container in accordance with claim 9 wherein sheilded venting means comprising the screening of claim 2 are also in presence.

* * * * *